US005316454A

United States Patent [19]

Fujitani et al.

[11] Patent Number: 5,316,454

[45] Date of Patent: May 31, 1994

[54] FLUID PUMP AND ROTARY MACHINE HAVING SAID FLUID PUMP

[75] Inventors: Makoto Fujitani; Yukio Nagato, both of Nagoya; Kimiharu Takeda, Aichi; Katsumi Hirooka, Aichi; Tetsuzo Ukai, Aichi; Toshiyuki Shikanai, Aichi, all of Japan

[73] Assignee: Mitsubishi Jukogyo Kabushiki Kaisha, Tokyo, Japan

[21] Appl. No.: 927,962

[22] Filed: Aug. 11, 1992

[30] Foreign Application Priority Data

Aug. 23, 1991 [JP] Japan ..... 3-237095

[51] Int. Cl.[5] ..... F04C 18/04; F04C 29/02; F04B 19/02; F04B 7/04

[52] U.S. Cl. ..... 418/55.6; 418/88; 417/460; 417/490; 417/491; 417/497; 417/521

[58] Field of Search ..... 418/55.6, 88; 417/460, 417/490, 491, 497, 521

[56] References Cited

FOREIGN PATENT DOCUMENTS

| | | | |
|---|---|---|---|
| 0387184 | 9/1990 | European Pat. Off. . | |
| 3903249 | 8/1989 | Fed. Rep. of Germany . | |
| 59-60091 | 4/1984 | Japan . | |
| 62-87693 | 4/1987 | Japan | 418/55.6 |
| 62-113880 | 5/1987 | Japan . | |
| 63-9692 | 1/1988 | Japan | 418/88 |
| 1277694 | 11/1989 | Japan | 418/55.6 |
| 227186 | 1/1990 | Japan . | |
| 2-95790 | 4/1990 | Japan | 418/55.6 |
| 3-85387 | 4/1991 | Japan | 418/88 |
| 3149391 | 6/1991 | Japan | 418/55.6 |

OTHER PUBLICATIONS

Proceedings-vol. II; 1990 International Compressor Engineering Conference at Purdue (Jul. 17-20, 1990, Perdue University, West Lafayette, Ind., U.S.A.).

*Primary Examiner*—John J. Vrablik

*Attorney, Agent, or Firm*—Birch, Stewart, Kolasch & Birch

[57] ABSTRACT

An inexpensive, efficient pump which can supply lubricating oil uses the revolving motion of an orbiting scroll 2. The pump is so constructed that a piston supported by a fixing member 1 is fitted in a cylinder chamber 102 formed in the inner surface of the end plate 21 of an orbiting scroll 2 which revolves while sliding on the fixing member, by which a pump chamber 104 is defined between them. The piston 101 is extended or retracted depending on the revolving motion of orbiting scroll 2, the volume of the pump chamber 104 is increased or decreased, and a fluid suction port 105 and a fluid discharge port 106 are connected to the pump chamber 104 at predetermined time intervals to supply the fluid.

11 Claims, 15 Drawing Sheets

θ=0°
102
104
105
106
101
P

θ=45°

θ=90°

θ=135°

θ=180°

θ=225°

θ=270°

θ=315°

0°

45°

90°

135°

180°

225°

270°

315°
101
105A
102
106A
110
112

θ=0°
106
105

101
120
θ=180°

θ=45°
θ

θ=225°

θ=90°

θ=270°

θ=135°

θ=315°

FLUID PUMP AND ROTARY MACHINE HAVING SAID FLUID PUMP

FIELD OF THE INVENTION AND RELATED ART STATEMENT

This invention relates to a fluid pump suitable as a lubricating oil pump for horizontal closed scroll compressor and a rotary machine having the fluid pump.

In the conventional vertical closed scroll compressor, lubricating oil stored at the bottom of a sealed housing is drawn up and supplied to the sliding parts of the scroll compression mechanism by a centrifugal pump incorporated into the rotatable shaft at its lower end.

In the horizontal closed scroll compressor, however, lubricating oil cannot be supplied by a centrifugal pump incorporated into the rotatable shaft at its lower end because the lower end of the rotatable shaft cannot be immersed in lubricating oil. Therefore, an inexpensive, reliable, and high-performance lubricating oil pump has been wanted which can be used for such kind of compressor.

OBJECT AND SUMMARY OF THE INVENTION

An object of this invention is to solve the above-described problem.

The gist of this invention to attain this object is as follows:

(1) A fluid pump of the present invention comprises a piston which is fitted between a orbiting member performing a revolving motion(in a solar motion) and a stationary member slidably in contact with the orbiting member and moves periodically in the radial or axial direction with respect to the orbiting member by the radial periodic displacement based on the revolution of the orbiting member; and a cylinder defining a pump chamber accommodating the piston, in which a fluid discharge port and a fluid suction port are formed in the pump chamber of the pump, and the fluid discharge port and the fluid suction port are opened at predetermined time intervals by the piston.

(2) If the fluid suction port is connected to a lubricating oil reservoir, and the fluid discharge port is connected at least to a lubricating place such as a bearing supporting the rotatable shaft of the orbiting member, the fluid pump can be used as a lubricating oil pump for rotary machine in which the rotatable shaft is installed apart from the lubricating oil reservoir.

(3) The fluid pump can be used as a lubricating oil pump for a scroll-type rotary machine having a fixed scroll member and an orbiting scroll member which revolves with respect to the fixed scroll member.

(4) The stationary member can be composed of a fixed scroll member or a fixing member for supporting both the orbiting scroll member and the fixed scroll member.

The operation of this invention is as follows: The piston moves periodically in the radial or axial direction by the periodic radial displacement based on the revolving motion of the orbiting member, by which the volume of the pump chamber is changed, and at the same time, the fluid discharge port and the fluid suction port are opened at predetermined time intervals. Thus, the fluid sucked into the pump chamber through the fluid suction port is energized and discharged through the fluid discharge port.

As described above, in the present invention, the piston moves periodically in the radial or axial direction by the periodic radial displacement based on the revolving motion of the orbiting member, by which the volume of the pump chamber is changed, and at the same time, the fluid discharge port and the fluid suction port are opened to the pump chamber at predetermined time intervals. Thus, the fluid sucked into the pump chamber through the fluid suction port can be energized and discharged to the required places through the fluid discharge port.

Also, the volume of the pump chamber can be increased or decreased by using the revolving motion of the orbiting member, and the fluid suction port and the fluid discharge port can be opened to the pump chamber at predetermined time intervals. Therefore, a suction valve and a delivery valve are unnecessary, so that an inexpensive, efficient, and reliable fluid pump can be provided.

If the fluid suction port is connected to a lubricating oil reservoir, and the fluid discharge port is connected to the lubricating places, the fluid pump can be used as a lubricating oil pump for rotary machine in which the rotatable shaft is installed apart from the lubricating oil reservoir.

Further scope of applicability of the present invention will become apparent form the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

A first embodiment in which this invention is applied to a horizontal closed scroll compressor will be described specifically with reference to FIGS. 1 through 3.

Figure 3:
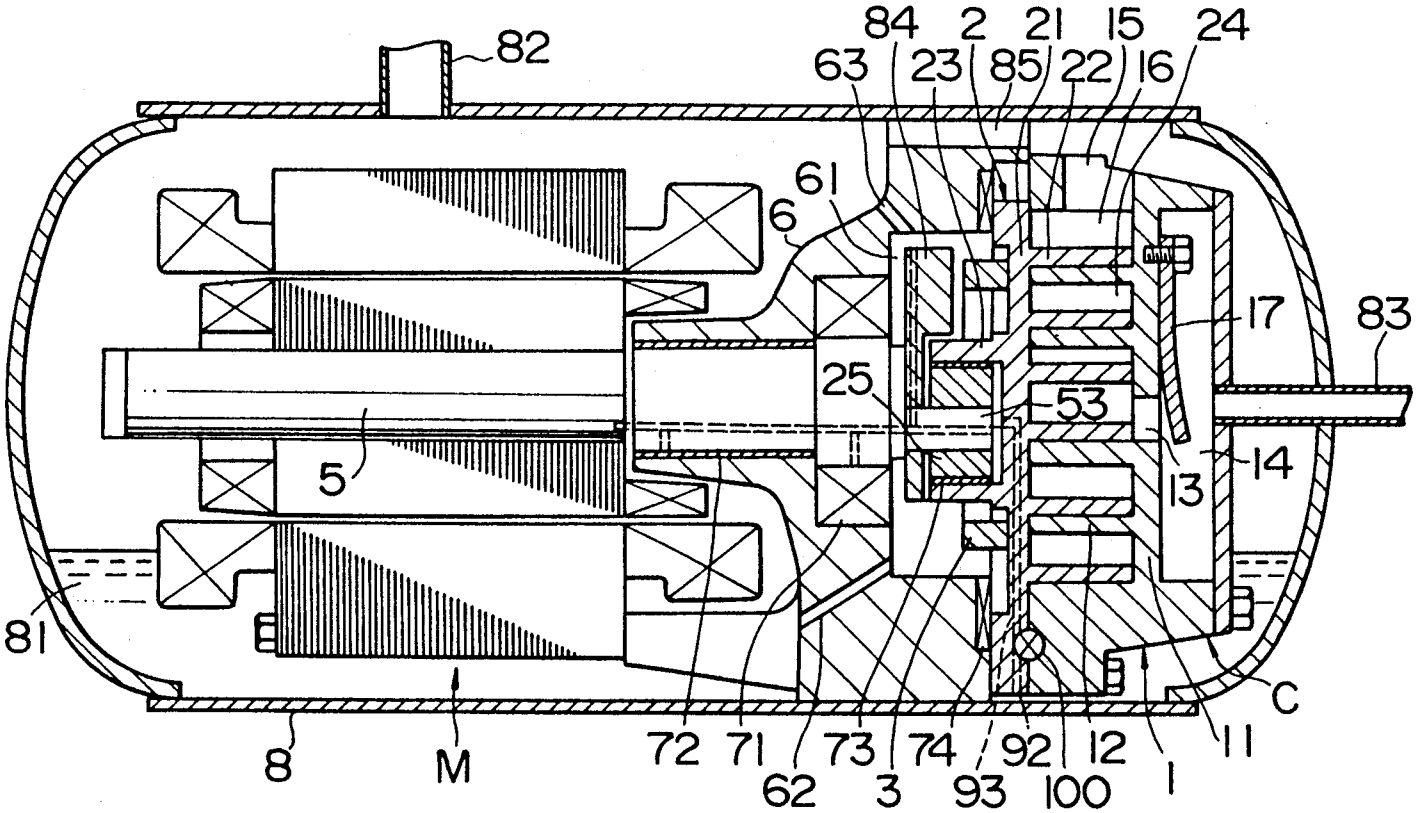
FIG. 3 is a longitudinal sectional view of a scroll-type rotary machine in accordance with the present invention.

As shown in FIG. 3, a scroll compression mechanism C and an electric motor M for driving the mechanism are disposed in a sealed housing 8 placed horizontally.

The scroll compression mechanism C comprises a fixed scroll 1, an orbiting scroll 2, a rotation checking member 3, such as Oldham's ring, which allows the revolution of orbiting scroll 2, but checks its rotation, a frame 6 for fastening the fixed scroll 1 and the electric motor M, bearings 71, 72 for journaling a rotatable shaft 5, and a rotating bearing 73 and a thrust bearing 74 for supporting the orbiting scroll 2.

The fixed scroll 1 has an end plate 11 and a spiral wrap 12 erected on the inner surface of the end plate 11, and the end plate 11 is provided with a discharge port 13 and a delivery valve 17.

The orbiting scroll 2 has an end plate 21 and a spiral wrap 22 erected on the inner surface of the end plate 21. In a boss 23 erected on the outer surface of the end plate 21, a drive bushing 25 is rotatively fitted via a rotating bearing 73. In an eccentric hole made in the drive bushing 25, an eccentric pin 53 protruding from the inner end of rotatable shaft 5 is rotatively fitted. The eccentric pin 53 has a balance weight 84.

By offsetting the fixed scroll 1 and the orbiting scroll 2 by a radius of revolution p and engaging them with the angle being shifted 180°, a plurality of sealed spaces 24 are formed symmetrically with respect to the center of spiral.

The driving of electric motor M drives the orbiting scroll 2 via a orbiting drive mechanism comprising the rotatable shaft 5, the eccentric pin 53, the drive bushing 25, and the boss 23. The orbiting scroll 2 revolves on a circular orbit of a radius of revolution p while its rotation is checked by the rotation checking member 3.

Then, gas enters a sealed housing 8 through a suction pipe 82. After the gas cools the electric motor M, it passes through a passage 85 formed in the frame 6, and is sucked into the sealed space 24 through a suction passage 15 and a suction chamber 16. As the volume of the sealed space 24 is decreased by the revolution of orbiting scroll 2, the gas reaches the central portion while being compressed. Then, the gas enters the discharge cavity 14 by pushing and opening the delivery valve 17 from the discharge port 13, and afterward it is discharged to the outside through a discharge pipe 83.

At the same time, lubricating oil 81 stored at the bottom of the sealed housing 8 passes through a suction passage 92 and is sucked and energized by a pump 100 disposed between the fixed scroll 1 and the orbiting scroll 2. The lubricating oil passes through an oil supply passage 93 and lubricates the bearing 72, the eccentric pin 53, the bearing 71, the rotation checking member 3, the rotating bearing 73, the thrust bearing 74 and other parts. Then, the lubricating oil is discharged through a chamber 61 and an oil drain hole 62, and stored at the bottom of the sealed housing 8. Reference numeral 63 denotes an equalizing hole for equalizing the pressure in the chamber 61 and the space in the sealed housing 8.

Figure 1:
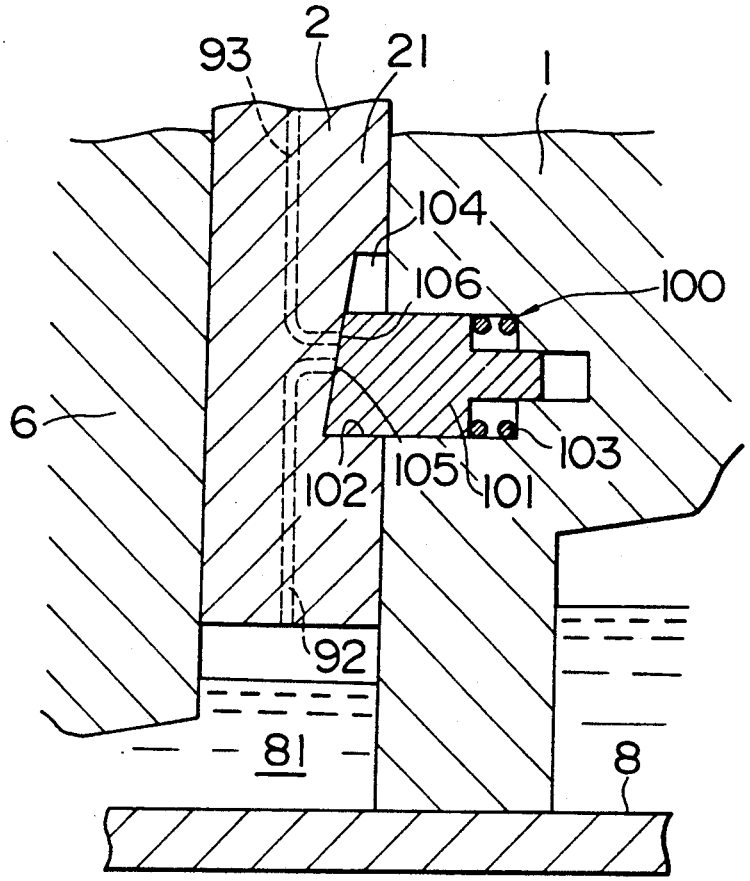
FIG. 1 is a partially longitudinal sectional view of a first embodiment of the present invention.

FIG. 1 shows the detail of the pump 100.

The pump 100 comprises a cylindrical piston 101 supported by the fixed scroll 1 in such a manner that it can be extended and retracted along the axis of revolution, a circular cylinder chamber 102 formed at the outer periphery on the inner surface of the end plate 21 of the orbiting scroll 2, and a spring 103 which is energized so as to extend the piston 101. The tip end of the piston 101 is fitted in the cylinder chamber 102 by offsetting by a radius of revolution $\rho$, by which the outer peripheral surface of piston 101 is slidably in contact with the inner peripheral surface of cylinder chamber 102 on one line, a crescent pump chamber 104 being defined between them. The tip end of the piston 101 is slidably in contact with the bottom surface of the cylinder chamber 102, and the tip end and the bottom surface are inclined in the radial direction. At the bottom of the cylinder chamber 102, a suction port 105 communicating with the suction passage 92 and a discharge port 106 communicating with the oil supply passage 93 are formed as shown in FIG. 2. The suction port 105 and the discharge port 106 are opened and closed by the tip end surface of the piston 101, so that the ports are opened to the pump chamber 104 alternatively at predetermined time intervals. The outer and inner surfaces of the end plate 21 of the orbiting scroll 2 slides sealingly in relation to the fixing scroll 1 and the frame 6, respectively.

Figures 2A, 2B, 2C, 2D, 2E, 2F, 2G, 2H:
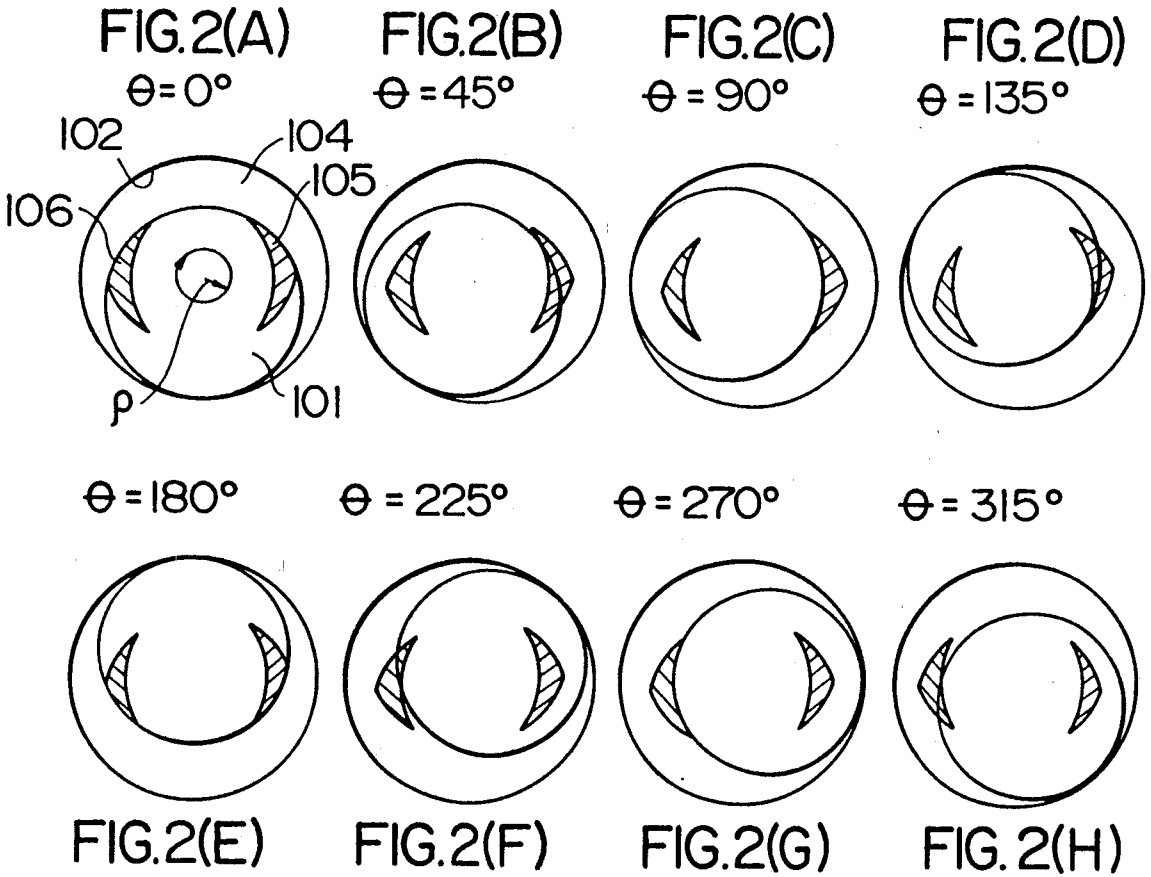
FIGS. 2(A)–2(H) are views illustrating the change of operation of the first embodiment.

When the orbiting scroll 2 revolves in solar motion as shown in FIG. 2 by the relative position at each revolving angle between the piston 101 and the cylinder chamber 102, the line contact portion between the outer peripheral surface of the piston 101 and the inner peripheral surface of the cylinder chamber 102 moves in accordance as each revolving angle $\theta$ shows 0° to 45°, 90°, 135°, . In the range of revolution angle from 0° to 180°, the suction port 105 opens to the pump chamber 104. The discharge port 106 is isolated from the pump chamber 104, and the piston 101 retracts gradually toward the stationary scroll 1 while sliding along its inclined surface and being pressed by the orbiting scroll 2 during this period. In the range of revolution angle from 180° to 360°, the discharge port 106 opens to the pump chamber 104. The suction port is isolated from the pump chamber 104, and the piston 101 gradually advances towards the orbiting scroll 2 while sliding along its inclined surface and being pressed by the spring 103. Thus, in the range of revolution angle from 0° to 180°, the piston 101 slides along its inclined surface in the direction of smaller portion of the pump chamber 104 so that the volume of the pump chamber increases gradually. At the same time, suction port 105 opens to the pump chamber 104 so that, the lubricating oil 81 stored at the bottom of the sealed housing 8 is sucked into the pump chamber 104 through the suction passage 92 and suction port 105 by the atmosphere pressure. In the range of revolution angle from 180° to 360°, the piston 101 slides along its inclined surface in the direction of the larger portion of the pump chamber so that the volume of the pump chamber 104 decreases gradually. At the same time, the discharge port 106 opens to the pump chamber 104 so that the lubricating oil in the pump chamber 104 is supplied, under its compression pressure, to sliding parts in the compressor through the discharge port 106 and the oil supply passage 93.

Figure 4A:
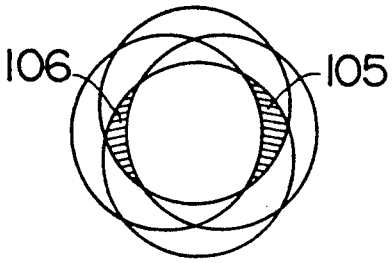
FIG. 4(A) is a view illustrating an almost ideal shape of a suction port and a discharge port of the first embodiment.
Figure 4B:
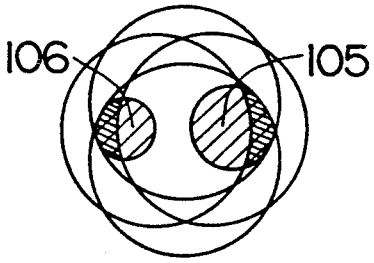
FIG. 4(B) is a view illustrating a circular shape of the suction port and the discharge port of the first embodiment.

The shapes of the suction port 105 and the discharge port 106 can be almost ideal by superposing the contours of outer peripheral surfaces of piston 101 at revolution angles of 0°, 90°, 180°, and 270° as shown in FIG. 4(A). However, the shapes may be circular as shown in FIG. 4(B). In this case, the machining is easy.

Figure 5:
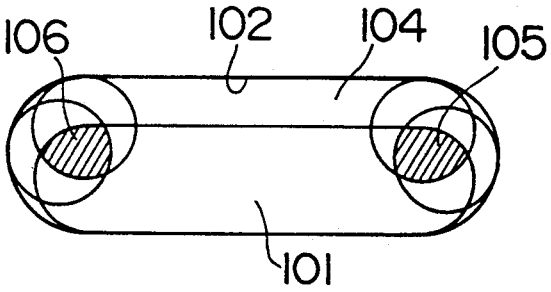
FIG. 5 is a view showing a modification of a cylinder chamber and a piston of the first embodiment.
Figure 6:
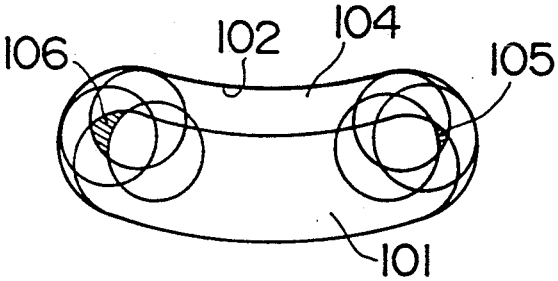
FIG. 6 is a view showing another modification of a cylinder chamber and a piston of the first embodiment.
Figure 7:
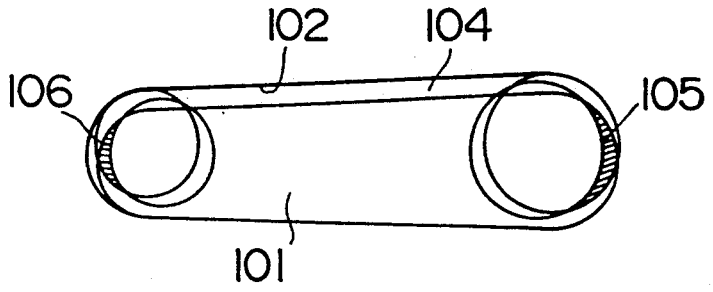
FIG. 7 is a view showing still another modification of a cylinder chamber and a piston of the first embodiment.

In the first embodiment described above, the cylinder chamber 102 and the piston 101 have a circular cross section. However, the cross section may be elliptic as shown in FIG. 5, of arc shape as shown in FIG. 6, or of wedge shape as shown in FIG. 7. Such modification is useful when the outside diameter of cylinder chamber 102 is restricted or when it is desired to increase the pump capacity by increasing its displacement.

Figure 8:
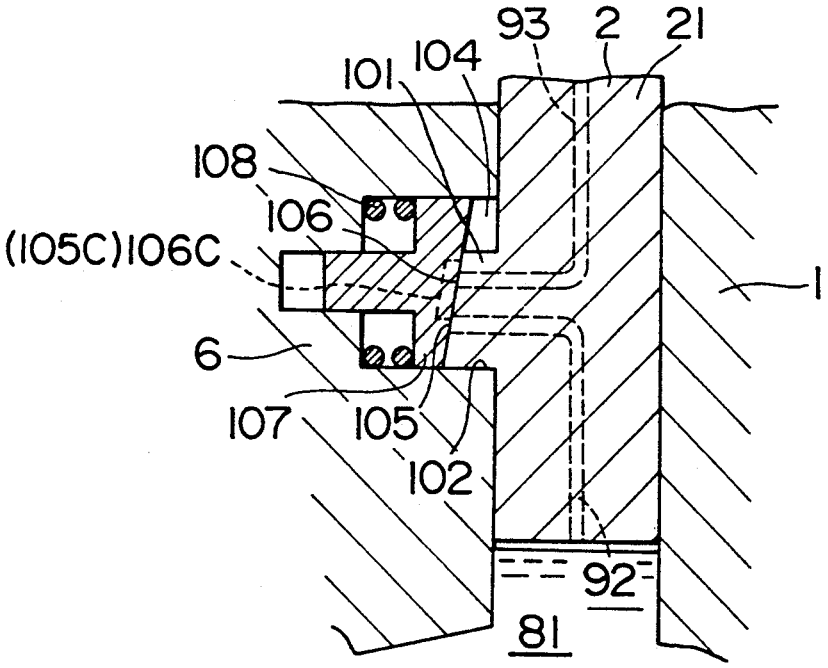
FIG. 8 is a partially longitudinal sectional view of a second embodiment of the present invention.

FIG. 8 shows a second embodiment of the present invention.

In the second embodiment, the piston 101 protrudes on the end plate 21 of the orbiting scroll 2, and this piston 101 is fitted in the cylinder chamber 102 formed in the frame 6. The bottom of the cylinder chamber 102 is defined by a plunger 107. This plunger 107 is supported by the frame 6 in such a manner that it can be extended and retracted along the axis of revolution, and energized by a coil spring 108 in the extending direction. On the tip surface of the piston 101, the suction port 105 and the discharge port 106 are open, the suction port 105 communicates with the pump chamber 104 through recess 105C in the surface of the plunger 107 when the volume of the pump chamber is increasing, and the discharge port 106 communicates with the pump chamber 104 through recess 106C in the surface of the plunger 107 when the volume of the pump chamber is decreasing.

Other arrangements are similar to that of the first embodiment, the same reference numerals being applied to the corresponding parts.

This second embodiment offers the same operation and effects as those of the first embodiment.

Figure 9:
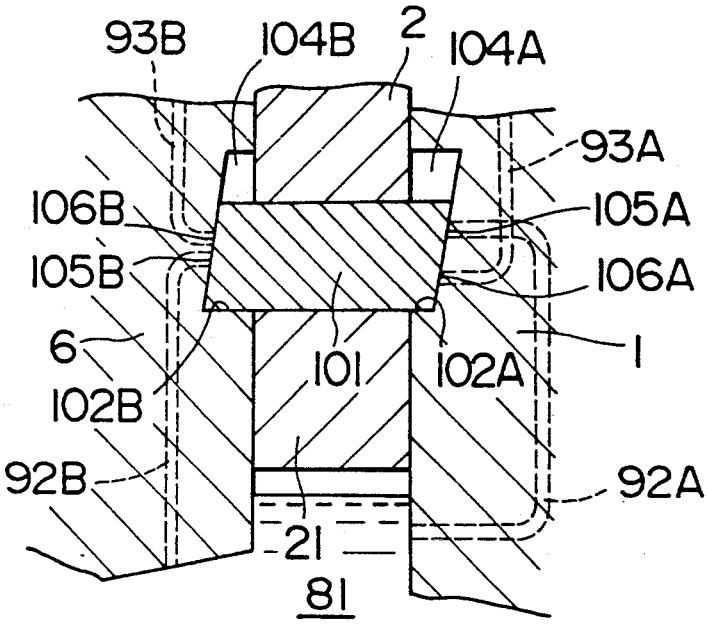
FIG. 9 is a partially longitudinal sectional view of a third embodiment of the present invention.

FIG. 9 shows a third embodiment of the present invention.

In the third embodiment, the piston 101 extends through the end plate 21 of the orbiting scroll 2, and is supported in such a manner that it can reciprocate in the direction of the axis of revolution. One end of the piston 101 is fitted in the cylinder chamber 102A formed in the fixing scroll 1, and the other end thereof is fitted in the cylinder chamber 102B formed in the frame 6. To the pump chamber 104A defined by one end of piston 101 and the cylinder chamber 102A, the suction port 105A communicating with the suction passage 92A and the discharge port 106A communicating with the oil supply passage 93A are open. To the pump chamber 104B defined by the other end of piston 101 and the cylinder chamber 102B, the suction port 105B communicating with the suction passage 92B and the discharge port 106B communicating with the oil supply passage 93B are open.

Other arrangements are similar to that of the first embodiment, the same reference numerals being applied to the corresponding parts.

This third embodiment eliminates the need for a spring and doubles the discharge quantity of pump.

Figure 10:
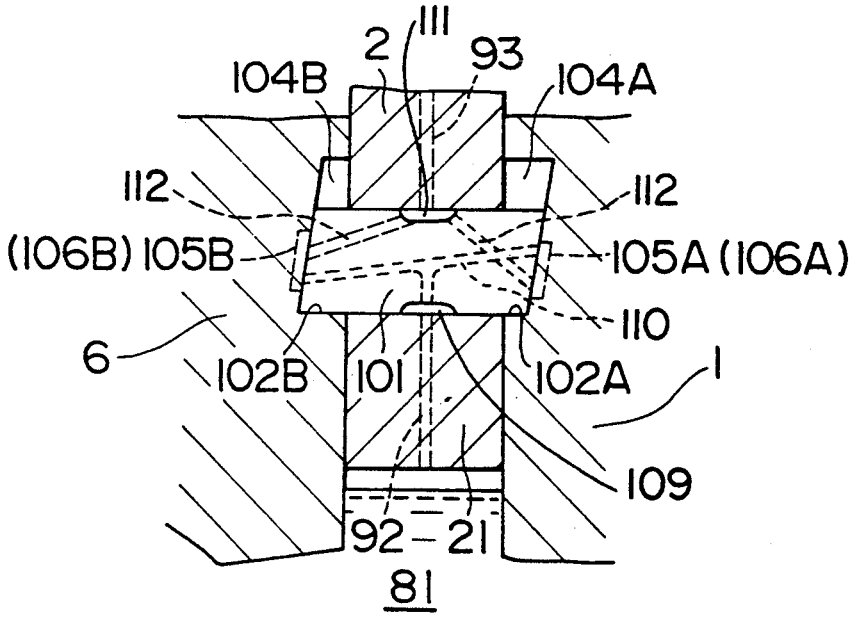
FIG. 10 is a partially longitudinal sectional view of a fourth embodiment of the present invention.
Figure 11:
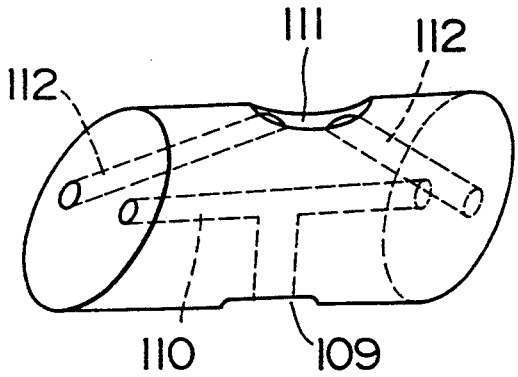
FIG. 11 is a perspective view of a piston of the fourth embodiment.
Figures 12A, 12B, 12C, 12D, 12E, 12F, 12G, 12H:
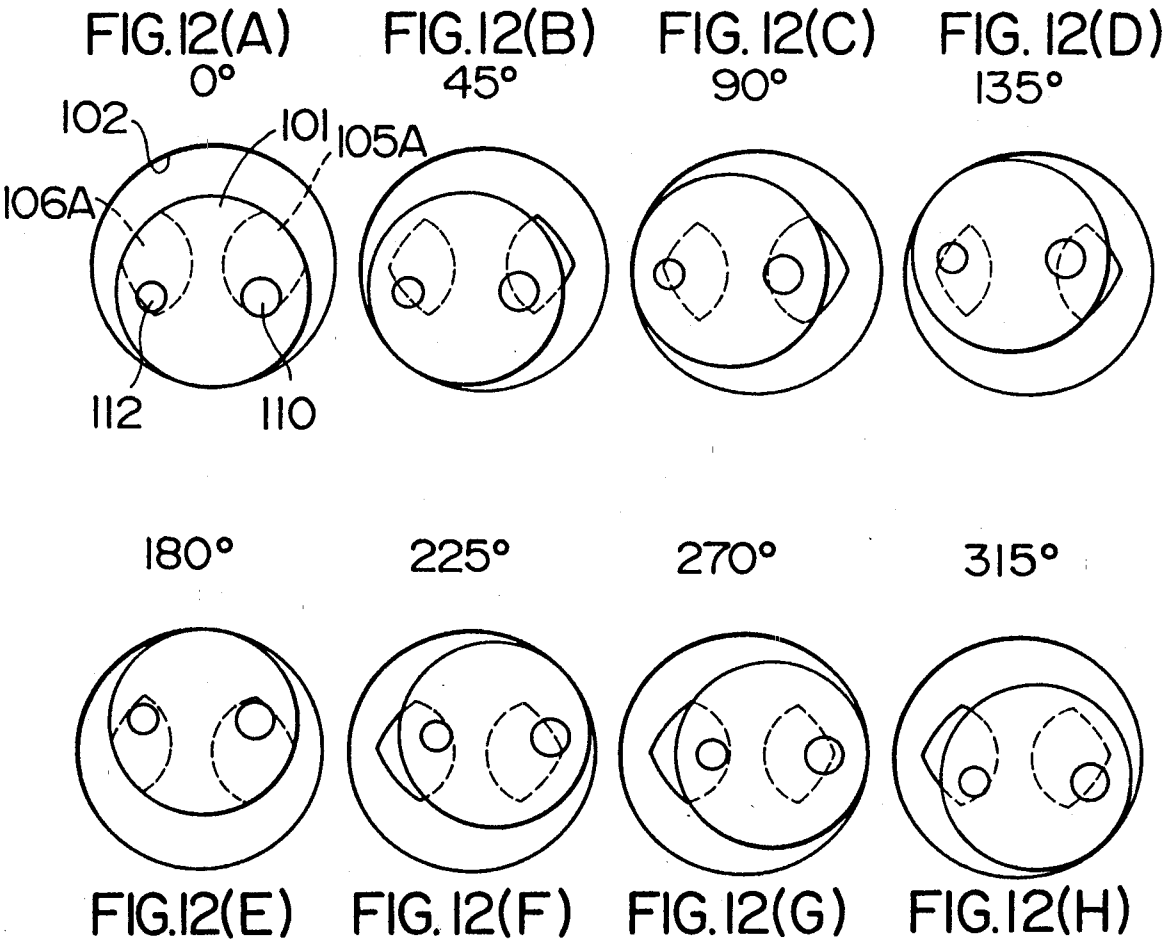
FIG. 12(A)-12(H) are views illustrating the change of operation of the fourth embodiment.

FIGS. 10 through 12 show a fourth embodiment of the present invention.

In the fourth embodiment, a recess 109 communicating with the suction passage 92 and a recess 111 communicating with the oil supply passage 93 are formed on the outer peripheral surface of the piston 101. The recess 109 opens to both end surfaces of the piston 101 via a through hole 110 made in the piston 101. These open ends are in communication with the suction port 105A, 105B consisting of a recess formed at the bottom of the cylinder chamber 102A, 102B.

The recess 111 opens to both end surfaces of the piston 101 via a through hole 112 made in the piston 101. These open ends are in communication with the discharge port 106A, 106B consisting of a recess formed at the bottom of the cylinder chamber 102A, 102B.

When the orbiting scroll 2 revolves, the piston 101 revolves in the cylinder chamber 102A and 102B as shown in FIG. 12. As a result, the through holes 110 and 112 opens to the pump chamber 104A via the suction port 105A and the discharge port 106A alternatively at predetermined time intervals. At the same time, they opens to the pump chamber 104B via the suction port 105B and the discharge port 106B alternatively at predetermined time intervals.

Other arrangements are similar to that of the third embodiment shown in FIG. 9, the same reference numerals being applied to the corresponding parts.

This fourth embodiment provides greater ease of machining than the third embodiment, leading to lower cost.

Figure 13:
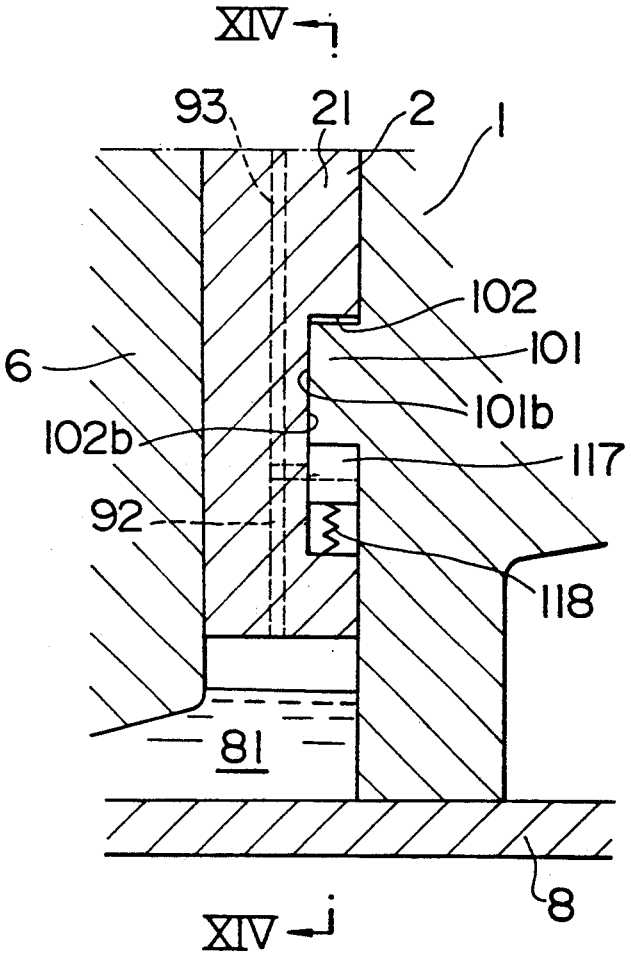
FIG. 13 is a partially longitudinal sectional view of a fifth embodiment of the present invention.
Figure 14:
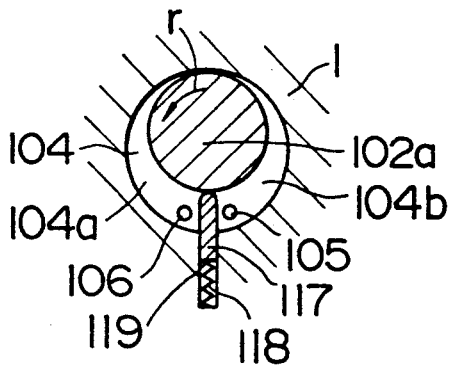
FIG. 14 is a sectional view taken on the plane of the line XIV—XIV of FIG. 13.

FIGS. 13 and 14 show a fifth embodiment of the present invention.

Reference numeral 101 denotes a cylindrical piston which protrudes on the fixed scroll 1 and extends in the direction of axis of revolution, 102 denotes a cylinder chamber of circular cross section which is formed at the outer periphery of the inner surface of the end plate 21 of the orbiting scroll 2, and 117 denotes a plate which is loosely inserted in a groove 119 formed in the end plate 21 of the orbiting scroll 2 in such a manner that it can be freely extended and retracted. The tip of the plate 117 is in contact with the peripheral surface of the piston 101 by the tension of a spring 118. The piston 101 is fitted in the cylinder chamber 102 by offsetting by a radius of revolution $\rho$, by which the outer peripheral surface of piston 101 is slidably in contact with the inner peripheral surface of cylinder chamber 102 on one line, a crescent pump chamber 104 being defined between them. This pump chamber 104 is divided into two parts: a compression chamber **104*a* is formed on one side, and a suction chamber 104*b*** on the other side.

The end surface **101*b* of the piston 101 is slidably in contact with the bottom surface 102*b* of the cylinder chamber 102. These surfaces 101*b*, 102*b* are in parallel to the revolution surface. On the bottom surface 102*b* of the cylinder chamber 102, the suction port 105 communicating with the suction passage 92 and the discharge port 106 communicating with the oil supply passage 93 are formed so that they are close to the plate 117 and positioned on both sides of the plate. The suction port 105 and the discharge port 106 are opened/closed by the piston 101. When the orbiting scroll 2 revolves, the piston 101 does not rotate around the center 102***a* of the cylinder chamber 102, but revolves on a circular orbit of a radius of revolution $\rho$. As a result, the volumes of the compression chamber 104*a* and suction chamber 104*b* increases/decreases periodically, and the suction port 105 and the discharge port 106 open to the suction chamber 104*b* and the compression chamber 104*a* at predetermined time intervals. Thus, the lubricating oil is sucked into the suction chamber 104*b* through the suction passage 92 and the suction port 105, and the lubricating oil in the compression chamber 104*a* is discharged from the discharge port 106 through the oil supply passage 93.

Figure 15:
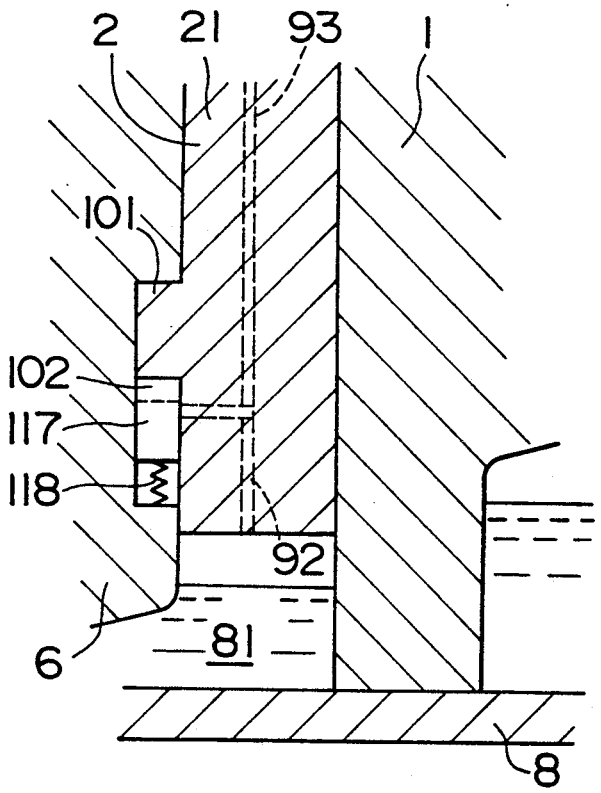
FIG. 15 is a partially longitudinal sectional view showing a modification of the fifth embodiment.
Figure 16:
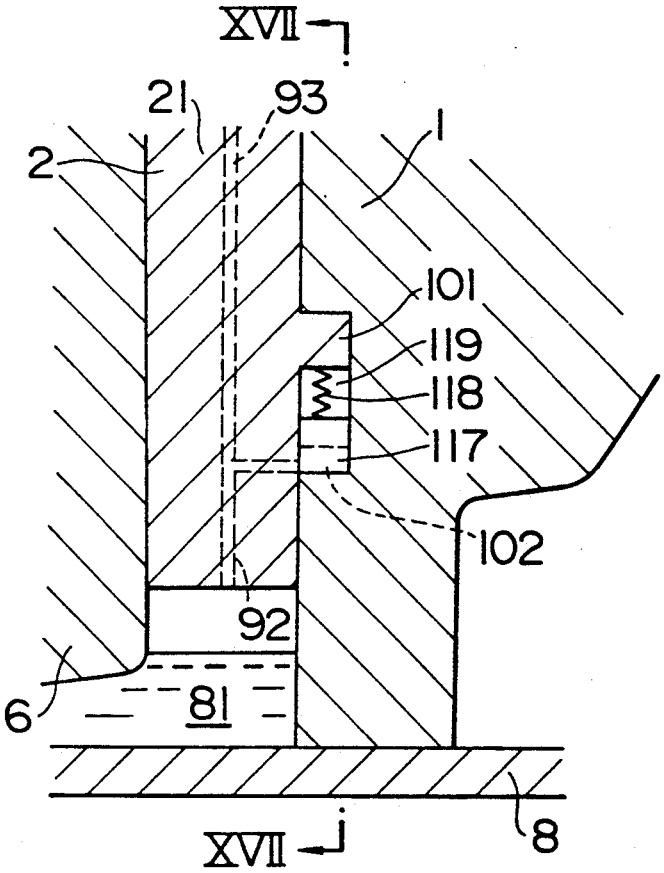
FIG. 16 is a partially longitudinal sectional view showing another modification of the fifth embodiment.
Figure 17:
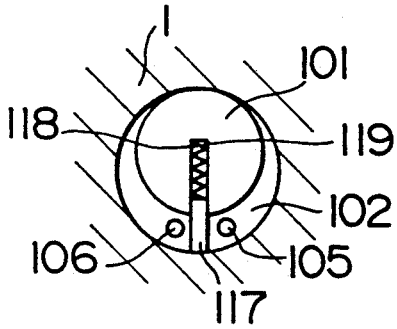
FIG. 17 is a sectional view taken on the plane of the line XVII—XVII of FIG. 16.

In this fifth embodiment, the fixed scroll 1 is provided with the piston 101, and the orbiting scroll 2 is provided with the cylinder chamber 102. However, the piston may be disposed on the end plate 21 of the orbiting scroll 2, and the cylinder chamber 102 may be disposed in the frame 6 as shown in FIG. 15. Also, the plate 117 and the spring 118 may be disposed in the piston 101 as shown in FIGS. 16 and 17.

Figure 18:
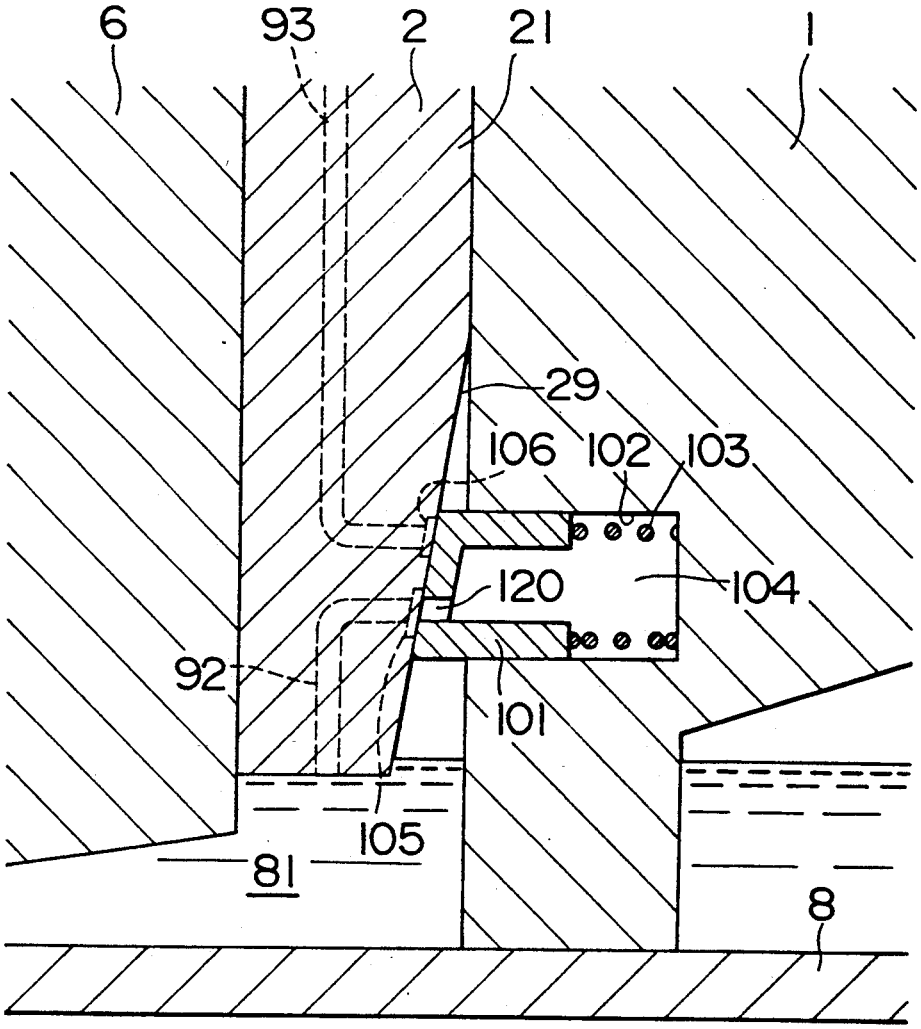
FIG. 18 is a partially longitudinal sectional view of a sixth embodiment of the present invention.
Figures 19A, 19B, 19C, 19D, 19E, 19F, 19G, 19H:
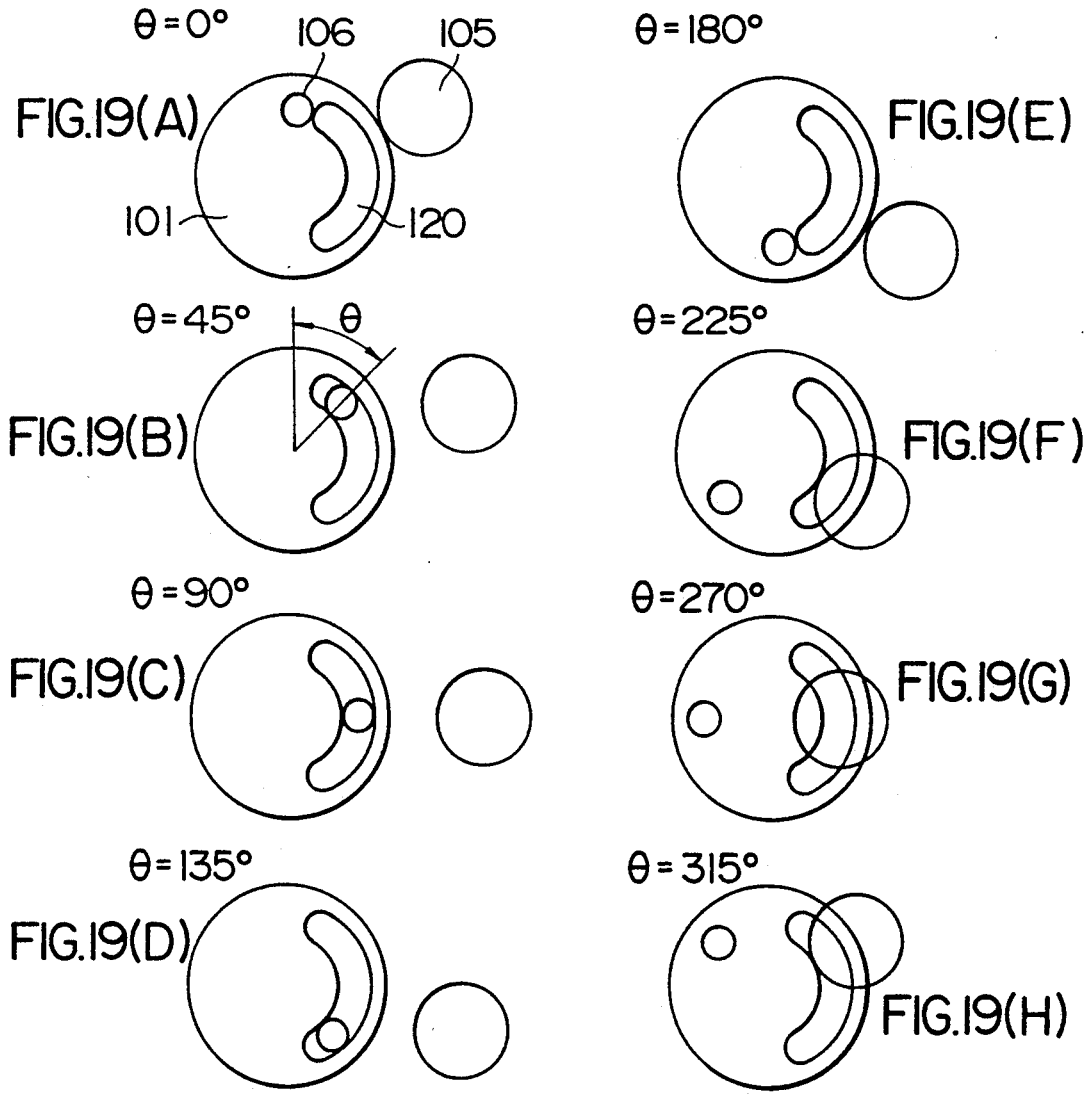
FIG. 19(A)-19(H) are views showing the change of operation of the sixth embodiment.

FIGS. 18 and 19 show a sixth embodiment of the present invention.

The piston 101 is fitted in the cylinder chamber 102 of circular cross section formed in the fixed scroll 1 and supported in the direction of axis of revolution in such a manner that it can be freely extended and retracted. This piston 101 is of a cup shape, and urged by a spring 103 installed in the rear of the piston 101. The tip end surface of the piston 101 is slidably in contact with an inclined surface 29 formed on the end plate 21 of the orbiting scroll 2. The tip end surface of the piston 101 and the inclined surface 29 are inclined in the radial direction.

To the inclined surface 29, the suction port 105 communicating with the suction passage 92 and the discharge port 106 communicating with the discharge passage 93 are open. In the tip end surface of the piston 101, semicircular through hole 120 is disposed.

When the orbiting scroll 2 revolves with a radius of revolution $\rho$, the piston 101 reciprocates in the direction of axis of revolution by sliding of its tip end surface on the inclined surface 29, by which the volume of the pump chamber 104 defined by the piston 101 and the cylinder chamber 102 increases or decreases. At the same time, the suction port 105 and the discharge port 106 are connected to the through hole 120 at predetermined time intervals as shown in FIG. 19.

If the revolution angle $\theta$ for the maximum volume of pump chamber 104 is taken as 0°, in the range of $\theta=0°-180°$ the piston 101 is pushed by the inclined surface 29, so that the volume of the pump chamber 104 decreases. As a result, the through hole 120 is connected to the discharge port 106, so that the lubricating oil in the pump chamber 104 is delivered to the oil supply passage 93 through the discharge port 106. In the range of $\theta=180°-360°$, the piston 101 is pushed out by the spring 103. As a result, the through hole 120 is connected to the suction port 105, so that the lubricating oil is sucked from the suction passage 92 into the pump chamber 104 through the suction port 105.

Figure 20:
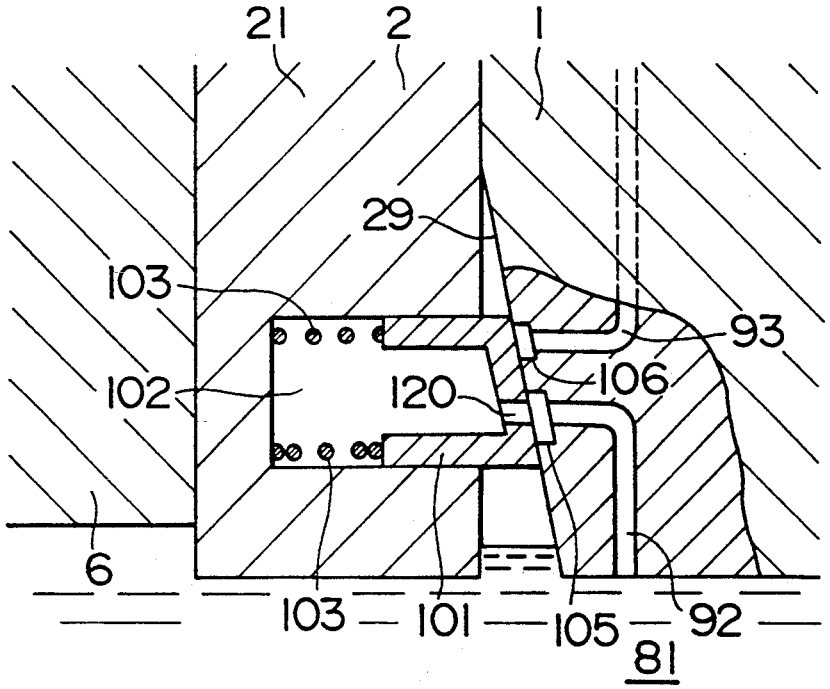
FIG. 20 is a partially longitudinal sectional view showing a modification of the sixth embodiment.
Figure 21:
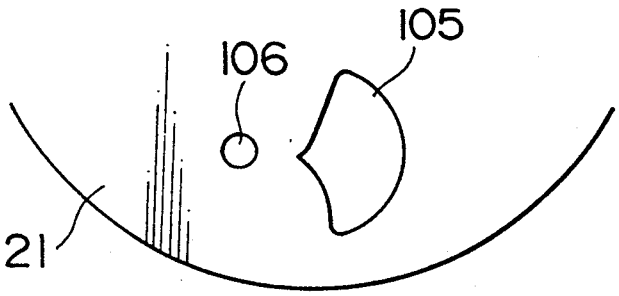
FIG. 21 is a view showing a modification of a suction port of the sixth embodiment.
Figure 22:
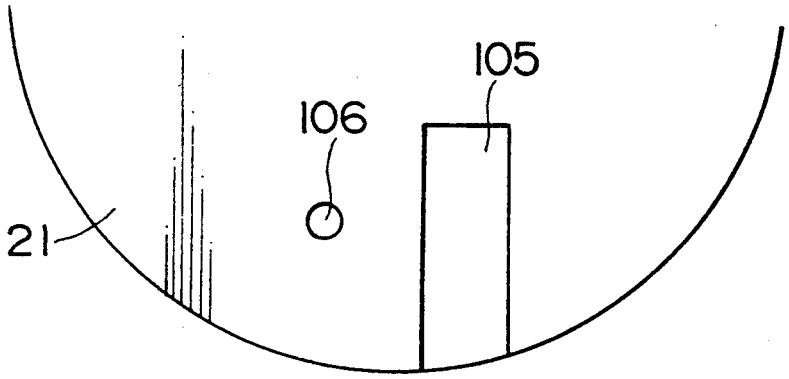
FIG. 22 is a view showing another modification of a suction port of the sixth embodiment.

As shown in FIG. 20, the piston 101 may be fitted in the cylinder chamber 102 formed in the orbiting scroll 2, and the inclined surface 29 may be formed on the fixed scroll 1. Also, the suction port 105 may be modified as shown in FIGS. 21 and 22. Further, in the above embodiments, a rotation preventing means such as a key or chamfering may be provided to prevent the rotation of the piston 101.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A fluid pump comprising:

a stationary member having a first thrust surface, said thrust surface being formed with a first cylindrical hole;

ar orbiting member having a second thrust surface, the orbiting member being rotatable relative to the stationary member, the second thrust surface sliding on the first thrust surface during rotation of the orbiting member, the second thrust surface having a second cylindrical hole, the second cylindrical hole being larger than the first cylindrical hole, said second cylindrical hole having an inclined surface, the inclined surface being inclined in a radial direction;

a piston having a part thereof slidably inserted in said first cylindrical hole of said stationary member and another inclined part thereof in surface contact with the inclined surface of said second cylindrical hole of said orbiting member; and a fluid discharge port and a fluid suction port formed in the inclined surface of said second cylindrical hole so that said piston moves periodically in the radial direction and revolving axial direction due to periodical displacement in the radial direction resulting from revolving motion of said orbiting member, said piston thereby opening and closing said fluid discharge port and said fluid suction port at predetermined time intervals.

2. The fluid pump as claimed in claim 1, wherein the orbiting member rotates about a rotational axis, the piston being urged in a direction generally parallel to the rotational axis by a spring.

3. The fluid pump as claimed in claim 1, wherein said fluid pump is utilized as a lubricant pump for a rotary machine, the rotary machine having a lubricant reservoir and a revolving shaft for said orbiting member, the fluid suction port being in communication with the lubricant reservoir and the fluid discharge port being in communication with at lest one lubricating place, the at least one lubricating place including the revolving shaft of the orbiting member, the revolving shaft being separated from said lubricant reservoir.

4. The fluid pump as claimed in claim 3, wherein the at least one place includes a bearing for the revolving shaft, the bearing supporting the revolving shaft.

5. The fluid pump as claimed in claim 3, wherein said stationary member is a fixed scroll and said orbiting member is an orbiting scroll, said rotary machine being a scroll-type rotary machine.

6. The fluid pump as claimed in claim 5, wherein said stationary member supports both of said scroll members.

7. A rotary machine comprising:

a fluid pump, the fluid pump having;

a stationary member having a first thrust surface, said thrust surface being formed with a first cylindrical hole, an orbiting member having a second thrust surface, the orbiting member being rotatable relative to the stationary member, the second thrust surface sliding on the first thrust surface during rotation of the orbiting member, the second thrust surface having a second cylindrical hole, the second cylindrical hole being larger than the first cylindrical hole, said second cylindrical hole having an inclined surface, the inclined surface being inclined in a radial direction, a piston having a part thereof slidably inserted in said first cylindrical hole of said stationary member and another inclined part thereof in surface contact with the inclined surface of said second cylindrical hole of said orbiting member, and a fluid discharge port and a fluid suction port formed in the inclined surface of said second cylindrical hole so that said piston moves periodically in the radial direction and revolving axial direction due to periodical displacement in the radial direction resulting from revolving motion of said orbiting member, said piston thereby opening and closing said fluid discharge port and said fluid suction port at predetermined time intervals;

a lubricant reservoir, the fluid suction port being in communication with the lubricant reservoir; and at least one lubricating place being in communication with said fluid discharge port, the at least one lubricating place including a revolving shaft of the orbiting member, the revolving shaft being separated from said lubricant reservoir;

said fluid pump being a lubricant pump for the rotary machine.

8. The rotary machine as claimed in claim 7, wherein the at least one lubricating place includes a bearing for the revolving shaft, the bearing supporting the revolving shaft.

9. The rotary machine as claimed in claim 7, wherein the orbiting member rotates about a rotational axis which is generally parallel to a longitudinal axis of the rotary machine, the piston being urged in a direction generally parallel to the longitudinal axis by a spring.

10. The rotary machine as claimed in claim 7, wherein said stationary member is a fixed scroll and said orbiting member is an orbiting scroll, said rotary machine being a scroll-type rotary machine.

11. The rotary machine as claimed in claim 10, wherein said stationary member supports both of said scroll members.

* * * * *